US008784286B2

(12) United States Patent
Reyes

(10) Patent No.: US 8,784,286 B2
(45) Date of Patent: Jul. 22, 2014

(54) POWER STRIDE APPARATUS AND METHOD OF TRAINING THEREFOR

(75) Inventor: Gil Reyes, Las Vegas, NV (US)

(73) Assignee: GRAA Innovations, LLC, Las Vegas, NV (US)

( * ) Notice: Subject to any disclaimer, the term of this patent is extended or adjusted under 35 U.S.C. 154(b) by 363 days.

(21) Appl. No.: 13/136,209

(22) Filed: Jul. 25, 2011

(65) Prior Publication Data

US 2011/0287911 A1 Nov. 24, 2011

Related U.S. Application Data

(63) Continuation-in-part of application No. 12/383,626, filed on Mar. 25, 2009, now Pat. No. 7,985,168.

(51) Int. Cl.

| | |
|---|---|
| ***A63B 21/04*** | (2006.01) |
| ***A63B 21/06*** | (2006.01) |
| ***A63B 23/04*** | (2006.01) |
| ***A63B 21/00*** | (2006.01) |
| ***A63B 23/035*** | (2006.01) |
| ***A63B 21/02*** | (2006.01) |
| ***A63B 21/055*** | (2006.01) |

(52) U.S. Cl.

CPC ..... *A63B 21/023* (2013.01); *A63B 23/0429* (2013.01); *A63B 2208/0238* (2013.01); *A63B 21/1492* (2013.01); *A63B 21/00069* (2013.01); *A63B 23/03541* (2013.01); *A63B 21/00072* (2013.01); *A63B 21/0421* (2013.01); *A63B 21/055* (2013.01)

USPC ..... 482/130; 482/94

(58) Field of Classification Search

CPC ..... A63B 21/04; A63B 23/03541; A63B 23/0355; A63B 21/143; A63B 21/1423; A63B 21/1492; A63B 2208/0233

USPC ..... 482/92–94, 97–103, 107, 121, 482/128–130, 135, 139, 141

See application file for complete search history.

(56) References Cited

U.S. PATENT DOCUMENTS

| | | | |
|---|---|---|---|
| 28,066 | A | 5/1860 | Couch |
| 1,139,126 | A | 5/1915 | Kerns |

(Continued)

FOREIGN PATENT DOCUMENTS

| | | | |
|---|---|---|---|
| KR | 10-1987-0004714 | A | 6/1987 |
| KR | 1988-0002587 | | 12/1998 |
| KR | 10-2006-0023850 | A | 3/2006 |

OTHER PUBLICATIONS

Written Opinion of the International Searching Authority (PCT/US2010/000928).

*Primary Examiner* — Stephen Crow
*Assistant Examiner* — Andrew S Lo
(74) *Attorney, Agent, or Firm* — One LLP

(57) ABSTRACT

The power stride apparatus and method therefor is directed to training the quads and gluts. In one embodiment, the apparatus comprises rotatable pedal assemblies having articulating pedals which may be engaged by a user's feet. The apparatus may include a seat to support the user. Resistance devices, such as one or more springs, may attach to the pedal assemblies to provide resistance to the movement of the pedal assemblies and to return to pedal assemblies to their initial position. The user may push the pedal assemblies and resist the return of the pedal assemblies thus training the user's quads and gluts. The articulating pedals allow training to be focused on the quads and gluts and provide a safer workout for the user. In some embodiments, return mechanisms may be used to allow the articulating pedals to follow the rotation of the user's foot during training.

13 Claims, 6 Drawing Sheets

(56) References Cited

U.S. PATENT DOCUMENTS

| | | | | | |
|---|---|---|---|---|---|
| 3,116,062 | A * | 12/1963 | Zinkin | 482/98 |
| 3,635,472 | A | 1/1972 | Marcyan | |
| 3,905,599 | A | 9/1975 | Mazman | |
| 4,208,049 | A | 6/1980 | Wilson | |
| 4,358,107 | A | 11/1982 | Nissen | |
| 4,511,137 | A * | 4/1985 | Jones | 482/100 |
| 4,809,976 | A * | 3/1989 | Berger | 482/130 |
| 5,094,449 | A * | 3/1992 | Stearns | 482/130 |
| 5,603,678 | A * | 2/1997 | Wilson | 482/97 |
| 5,776,040 | A * | 7/1998 | Webb et al. | 482/98 |
| 5,833,582 | A | 11/1998 | Chen | |
| 6,336,894 | B1 | 1/2002 | Kestila | |
| 6,447,430 | B1 * | 9/2002 | Webb et al. | 482/98 |
| 6,533,710 | B2 * | 3/2003 | Lin et al. | 482/123 |
| 6,561,956 | B1 | 5/2003 | Allison | |
| 6,705,976 | B1 * | 3/2004 | Piane, Jr. | 482/103 |
| 8,652,015 | B2 * | 2/2014 | Casadei et al. | 482/94 |
| 2005/0085351 | A1 * | 4/2005 | Kissel | 482/94 |
| 2005/0096196 | A1 * | 5/2005 | Webber et al. | 482/94 |
| 2005/0096197 | A1 * | 5/2005 | Webber et al. | 482/94 |
| 2005/0096198 | A1 * | 5/2005 | Webber et al. | 482/97 |
| 2005/0272573 | A1 * | 12/2005 | Carter | 482/99 |
| 2006/0019804 | A1 * | 1/2006 | Young | 482/93 |
| 2006/0148622 | A1 | 7/2006 | Chen | |
| 2006/0160677 | A1 | 7/2006 | Piane | |
| 2007/0167299 | A1 * | 7/2007 | Simonson et al. | 482/100 |
| 2007/0232462 | A1 * | 10/2007 | Webber et al. | 482/93 |
| 2007/0270290 | A1 * | 11/2007 | Mosimann et al. | 482/100 |
| 2007/0270291 | A1 * | 11/2007 | Piane, Jr. | 482/120 |
| 2009/0017997 | A1 * | 1/2009 | Piggins | 482/94 |
| 2009/0170668 | A1 * | 7/2009 | Giannelli et al. | 482/94 |
| 2010/0087298 | A1 * | 4/2010 | Zaccherini | 482/139 |
| 2010/0248916 | A1 * | 9/2010 | Reyes | 482/130 |
| 2011/0183817 | A1 * | 7/2011 | Giannelli et al. | 482/94 |
| 2011/0224052 | A1 * | 9/2011 | Webber et al. | 482/94 |
| 2011/0237405 | A1 * | 9/2011 | Reyes | 482/94 |
| 2012/0190514 | A1 * | 7/2012 | Bowser et al. | 482/123 |

* cited by examiner

POWER STRIDE APPARATUS AND METHOD OF TRAINING THEREFOR

CROSS REFERENCE TO RELATED APPLICATIONS

This application is a continuation-in-part of U.S. patent application Ser. No. 12/383,626, filed Mar. 25, 2009, now pending, the disclosure of which is hereby incorporated by reference as if set forth fully herein.

BACKGROUND OF THE INVENTION

1. Field of the Invention

The invention relates to exercise equipment and in particular to an apparatus and method of training for the gluts and quads.

2. Related Art

Traditional training machines for the gluts, quads, and other muscles of the lower extremities are known. These machines include leg press machines of various configurations where a user's body is supported by the machine while his or her legs are free to push weights upward against gravity to exercise the muscle.

For example, it a traditional machine, a user may be supported in a seated position such that his or her legs engage a movable structure having one or more weights. The user trains by extending and contracting his or her legs thus moving the weights. Typically, traditional machines must be engaged by both of a user's legs. In addition, traditional machines typically utilize weights which can only provide a fixed resistance.

Though traditional machines may provide training for the gluts and quads, such training is not as effective as with the machine and associated method disclosed herein. Thus, what is provided herein is a novel apparatus and method for training these muscles.

SUMMARY OF THE INVENTION

To overcome the drawbacks and provide additional benefits disclosed herein is a power stride apparatus and method of training using the power stride apparatus. The power stride apparatus and the method may be used to train a user's quads and gluts, and other associated muscle use to during the exercise. The power stride apparatus has various unique aspects which allow it to more effectively provide training as compared to traditional machines.

In one embodiment, the power stride apparatus may comprise a frame, at least one pedal assembly rotatably attached to the frame, at least one resistance device attached to the pedal assembly and the frame. Also part of this embodiment is a seat configured to support the user whereby the user faces the pedal assembly when seated. One or more handles located adjacent to the seat may be provided to allow a user to stabilize him or herself during training.

The pedal assembly may be configured in various ways. For example, the pedal assembly may comprise an articulating pedal which may be configured to rotate with a user's foot during training. It is noted that where there are multiple pedal assemblies, each pedal assembly may be configured to rotate independent of the other pedal assemblies.

In addition, the pedal assembly may comprise a return mechanism in one or more embodiments. The pedal assembly may also comprise a stop configured to prevent the at least one pedal assembly from rotating past a certain point. The return mechanism may be configured to rotate the articulating pedal towards the user. In this manner, the articulating pedal can follow the rotation of the user's foot during training. This can reduce the likelihood the foot muscles, and not the leg muscles, are providing the force. The return mechanism may have various configurations. In one embodiment, the return mechanism comprises a piston rotatably attached to the pedal assembly.

The resistance devices may be adjustable in some embodiments. For example, the apparatus may comprise one or more mounts attached to at least one pedal assembly and the frame. This allows the position of the resistance devices to be adjusted. Various types of resistance devices may be used. In one embodiment, the resistance device comprises one or more weight stacks. In another embodiment, the resistance device comprises one or more variable resistance devices. In another embodiment, the resistance device comprises one or more combinations of a weight stack and a variable resistance device.

The method of training at a power stride apparatus may comprise sitting on a seat of the power stride apparatus and then engaging an articulating pedal of the power stride apparatus with at least one foot. Then, the user would push the at least one pedal assembly forward against a resistance provided by the power stride apparatus. The rotatable nature of the foot pedals allows the foot to rotate while pushing the pedal assembly forward and during the return of the pedal. This will more likely maintain the entire foot in contact with the articulating pedal. It is contemplated that, in some embodiments, the foot may remain substantially in contact with the articulating pedal. It is also contemplated that, where applicable, each of the user's feet may move independently of one another during training.

The method may also comprise allowing the pedal assembly to return to its original position. During the return motion the pedal can also rotate while keeping the at least one foot in contact with the articulating pedal. The method may also comprise resisting the return force of the pedal assembly. It is noted that in some embodiments the user may grasp one or more handles of the power stride apparatus during training.

In one embodiment, the resistance assembly comprises a resistance device configured to provide resistance, a cable having a first end and a second end and configured to transfer the resistance provided by the resistance device to the user, and pulleys configured to guide the first end of the cable to the pedal assembly. The cable may be attached to the articulating pedal or pedal assembly at the first end and attached to the resistance device at the second end. In this manner, the resistance assembly may be user engageable by the user pressing on the articulating pedal.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

Figure 1:
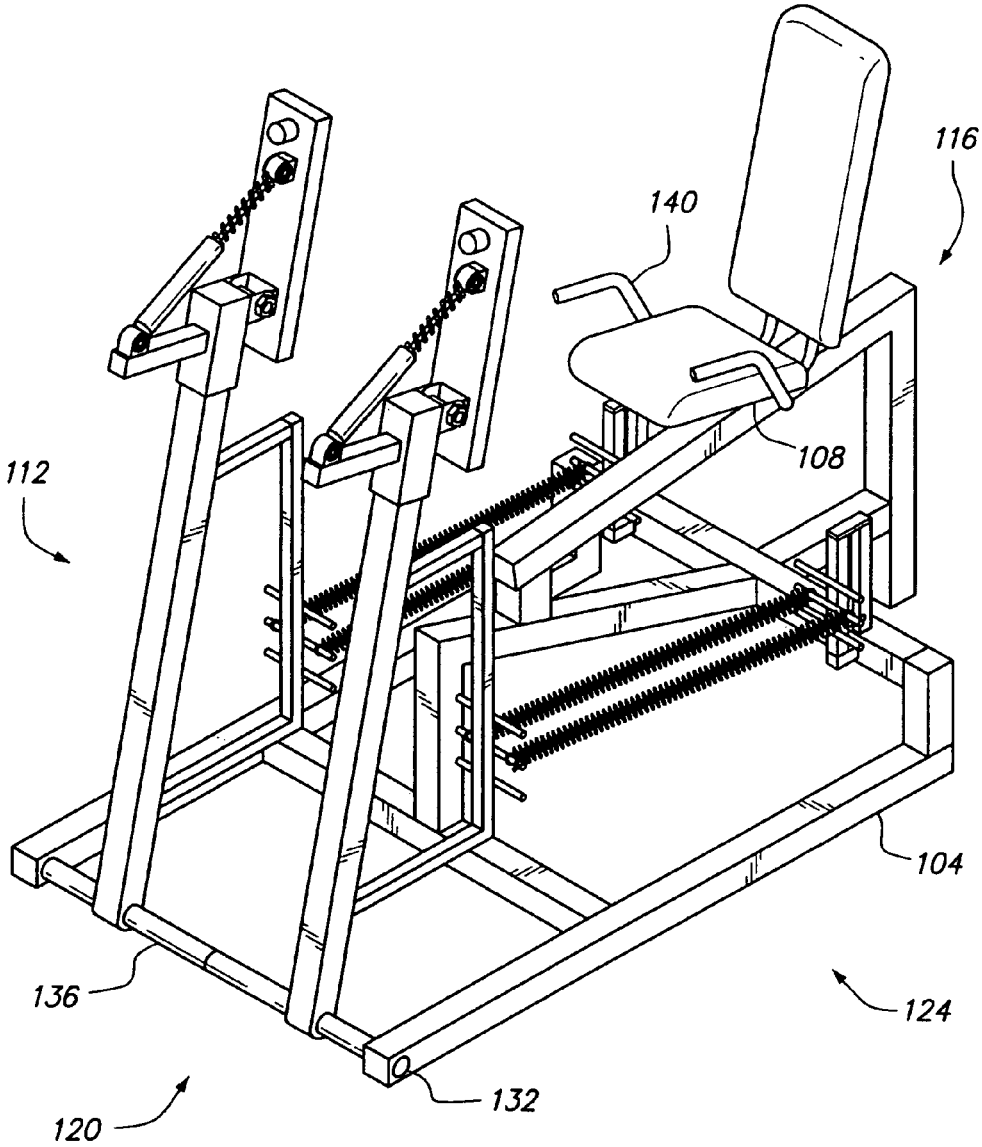
FIG. 1 is a perspective view of an exemplary embodiment of a power stride apparatus.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The power stride apparatus disclosed herein is directed to training the gluts and quads. In addition, other muscle groups are also trained. As used herein, the term gluts refers to the muscles of the gluteus maximus and the term quads refers to the muscles of the quadriceps. In one or more embodiments, the power stride apparatus allows a user to train these muscles in a seated position to focus the user's effort on the quads and gluts. In addition, the power stride apparatus provides variable resistance against the user's leg motion to provide more effective training, especially when compared to traditional devices where a fixed resistance is provided by one or more weights. The term variable resistance may refer to non-linear resistance.

As will be described below, the power stride apparatus may include one or more articulating pedals which allow a user's feet to pivot during training. This allows a user's feet to remain flat against the pedals during training. In this manner, the pedals distribute the forces generated during training evenly across the user's feet rather than a single point on the user's feet. This is highly advantageous in that training is safer for the user, especially where the power stride apparatus is being used for rehabilitation.

In traditional machines, such as leg press machines, the user's foot must pivot to accommodate the machine rather than the machine pivoting to accommodate the motion of the user's foot during training. This is because, in traditional machines, the portion of the machine which is engaged by the user's feet is fixed and does not rotate or pivot as the user's foot pivots at the ankle and within the foot itself. In contrast, the power stride apparatus has articulating pedals which pivot to accommodate the pivot of the user's feet during training. This provides another advantage in that the training is more effectively focused on the desired muscles, namely the gluts and quads. To illustrate, a user of the power stride apparatus applies force through his or her feet during training. However, the user's feet are allowed to rotate thus allowing the user to exert force with his or her quads and gluts rather than other muscles, such as the calves or foot muscles, which are used to stabilize the user's ankles or feet.

It is specifically contemplated that the power stride apparatus may be used to increase athleticism and speed, especially running speed. The quads and gluts are used extensively during running to lift and power the legs. Thus, the various embodiments of the power stride apparatus disclosed herein as well as its articulating pedals and other novel features provide many benefits to runners, athletes, and ordinary users.

The power stride apparatus will now be described with regard to the figures. FIG. 1 is a perspective view of an exemplary embodiment of the power stride apparatus having a front 120 and a back 116. As shown, the power stride apparatus comprises a frame 104 which generally supports the other components of the apparatus. Typically, the frame 104 will be a rigid structure configured to support the components of the power stride apparatus as described herein. The frame may be constructed from various materials including but not limited to one or more metals, alloys, and composites. In addition the frame may be constructed from wood, carbon fiber, or plastic. In fact, it is contemplated that any suitability rigid material may be used to construct the frame.

As illustrated, the frame 104 is comprised of a plurality of members which give the frame its general shape and which provide areas for the components of the power stride apparatus to be attached. The frame 104 shown in FIG. 1 has rectangular or square members; however, it is noted that members of various shapes and cross sections may be used. In some embodiments, the frame 104 may include planar or other shaped members rather than the elongated members shown in FIG. 1. It will be understood that the members of the frame 104 may be arranged and attached to one another in various ways as long as the components of the power stride apparatus are supported in their proper location as will be described herein.

In one embodiment, such as the embodiment of FIG. 1, the frame 104 comprises a rectangular base section 124. The front 120 of the frame 104 may be open. This allows an axle 132 to be located at the front 120 of the frame 104 As will be described further below, the axle 132 may rotatably support one or more pedal assemblies 112. At the back 116 of the power stride apparatus, a portion of the frame 104 may extend upward to support a seat 108, As shown, angled members extend upward to support the seat 108 in FIG. 1. Of course, other configurations of the frame 104 may be used. A portion of the frame 104 also extends outward from the base 124 at the back 116 of the power stride apparatus to provide additional stability to the seat 108. As will be described further below, the springs illustrated in FIG. 1, may be supported on one end by the frame 104 in one or more embodiments.

In one embodiment, the frame 104 supports a seat 108 and two pedal assemblies 112. The seat 108 may be located at the back 116 of the power stride apparatus, and the pedal assemblies 112 may be located at the front 120 of the apparatus. As can be seen from FIG. 1, the seat 108 and the pedal assemblies 112 face one another to allow a user to sit in the seat and engage the pedal assemblies with his or her feet. As will be described further below, a user may train by extending and retracting his or her legs while engaged to the pedal assemblies 112.

The seat 108 may be any support, now known or later developed, which is capable of supporting a seated user. The seat 108 may be padded or unpadded in one or more embodiments. Typically, but not always, the seat 108 will include a back to support the user's back during training. The back of the seat 108 is advantageous in that it keeps the user from sliding off the seat when the user pushes on the pedal assemblies 112. However, it is contemplated that the seat 108 need not have a back in all embodiments. In some embodiments, one or more handles 140 may be provided near the seat 108 which a user may grasp to prevent him or herself from sliding off the seat during training. It is noted that the handles 140 may also be provided in embodiments where the seat 108 has a back.

Figure 2:
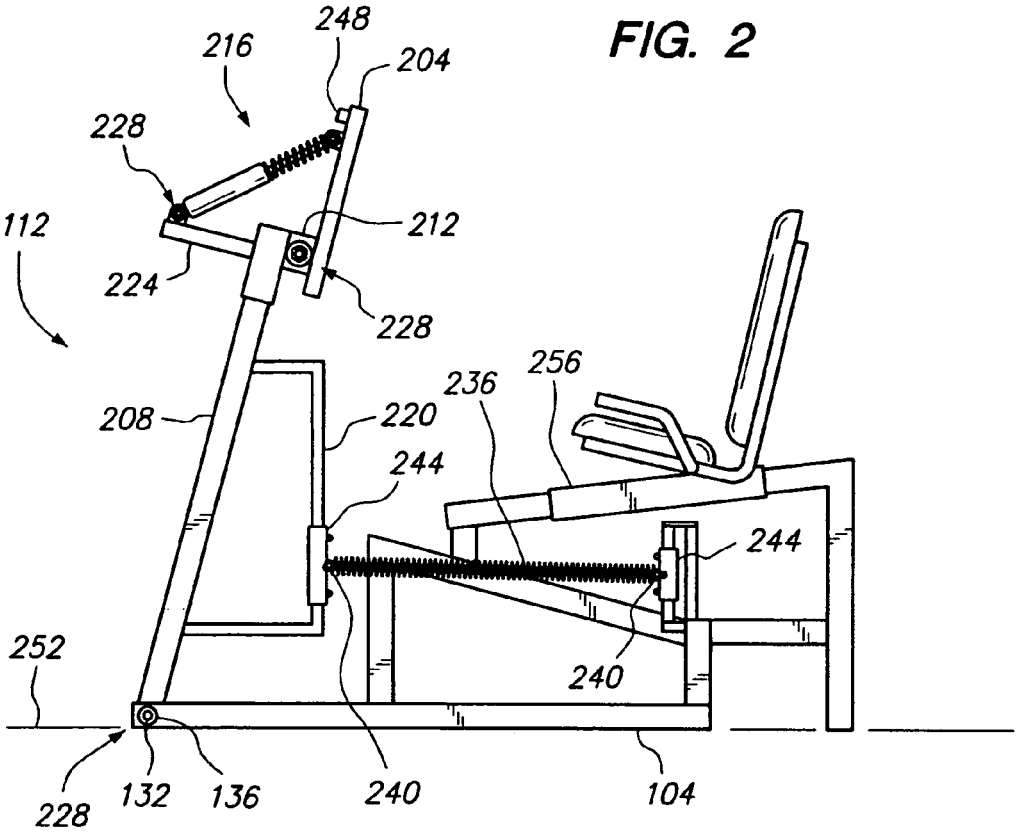
FIG. 2 is a side view of an exemplary embodiment of a pedal assembly.

It is contemplated that the seat 108 may be adjustable in one or more embodiments. For example, the seat 108 may be moved closer or further away from the pedal assemblies 112 to accommodate users with legs of various lengths. In one embodiment, the seat 108 may slide along a portion of the frame 104 to a desired position. Once in the desired position, the seat 108 may be secured in place by one or more fasteners. For example, one or more screws, pins, clamps, clips, or the like may be used to secure the seat 108 in place. In the embodiment of FIG. 2, the seat 108 includes a guide 256 which allows the seat to more easily slide or otherwise be repositioned along a portion of the frame 104.

The pedal assemblies 112 are movable and provide a resistance in one or more embodiments. The pedal assemblies may be height adjusted, width adjusted, or angle adjusted. This allows the users of various sizes and builds to universally train on the power stride apparatus though minimal adjustment of the machine. An exemplary embodiment of a pedal assembly 112 is shown in FIG. 2. Typically, two pedal assemblies 112 will be provided to engage both of the user's legs as shown in FIG. 1. It is noted however that the power stride apparatus may be configured with a single pedal assembly 112 in some embodiments. The single pedal assembly 112 may be configured to engage one leg/foot at a time or both of the user's legs/feet.

The pedal assemblies 112 may be independent in one or more embodiments so that each pedal assembly may move independent of the other pedal assembly. This is beneficial in that both of the user's legs experience the same level of resistance and thus may be trained equally. To illustrate, in some existing machines, such as hack squats, stationary bikes, or elliptical trainers, the machines' pedals are physically linked so that force applied to one pedal moves both pedals. During training, a user may unknowingly favor one side or leg when moving the pedals. The favored side or leg exerts more force in moving the pedals and thus becomes stronger than the user's other side or leg. In contrast, the independent pedal assemblies 112 of the power stride apparatus do not allow the force of one side or leg to move both pedal assemblies. In this manner, training is equal between the user's sides or legs making both legs of the user equally strong, or at least receive equal training.

A user may train on the power stride apparatus by pushing a pedal assembly 112 and then allowing the pedal assembly to return to an initial position. The initial position of a pedal assembly 112 will generally refer to a position of the pedal assembly where the pedal assembly has not been rotated or substantially rotated. In one embodiment the initial position is the position of the pedal assembly 112 prior to the user pushing the pedal assembly. In another embodiment, the initial position is the position of the pedal assembly 112 when the user has engaged the pedal assembly but has not yet pushed the pedal assembly.

In one or more embodiments, a biasing force or resistance may be provided by the pedal assembly 112. As the user pushes and allows the pedal assembly 112 to return, the force provided by the resistance is applied to the user's quads and gluts. The user must overcome this force to push the pedal assembly 112 and resist this force as the pedal assembly returns. This provides training to the user's quads and gluts. The resistance or the force it provides may also pull, push, or otherwise return the pedal assembly 112 to its initial position when the user stops pushing the pedal assembly or reduces the force he or she is exerting on the pedal assembly. The resistance may be provided by various resistance devices as will be described below.

FIG. 2 shows a side view of an exemplary embodiment of a pedal assembly 112. As shown, the pedal assembly 112 comprises a pedal support 208 having a stop 220 to which a pedal 204, pedal return 216, and spring 236 may be attached. In general, the pedal support 208 is a rigid structure which supports the components of the pedal assembly 112. As shown, the pedal support 208 comprises an elongated member which extends upward from the frame 104 of the power stride apparatus. This allows the pedal 204 to be attached at the upper portion of the pedal support 208 so as to be engageable by a seated user's feet. Though shown as a square shaped tube, it is noted that the pedal support 208 may comprise members or other structures of various shapes and configurations as long as the pedal 204 and other components of the pedal assembly 112 can by supported according to the invention herein.

The pedal support 208 may have a pivot 228 to allow the pedal assembly 112 to move during training. In this manner, the pedal assembly 112 may swing or rotate about an axis during training. As shown in FIGS. 1-2, the pivot 228 comprises a round sleeve 136 which accepts an axle 132 therethrough. The axle 132 may be located at the front 120 of the power stride apparatus. In this manner the pedal assemblies 112 pivotally attached to the axle 132 can be located in front of a seated user. Stops may be provided to prevent the pedal from over rotating. This allows the user to easily engage the pedal assemblies 112 with his or her feet.

The sleeve's 136 round shape allows it to rotate around the axle 132 thus allowing the pedal assembly 112 to rotate about the axle. It is noted that the sleeve 136 also serves to secure the pedal assembly 112 to the frame 104 in this embodiment. The sleeve 136 may be elongated as well so that the pedal assembly 112 remains substantially perpendicular to the axle 132 when pivoting. The sleeve 136 may also be elongated so that the pedal assemblies 112 do not move sideways along the length of the axle 132. For example, as shown in FIG. 1, the sleeves 136 of the two pedal assemblies 112 are approximately half the length of the axle 132 n this manner, the pedal assemblies 112 cannot move sideways along the length of the axle 132.

It will be understood that any structure or component which allows a pedal assembly 112 to rotate about an axis, now known or later developed, may be used as a pivot 228. For example, a pivot 228 may comprise a hinge, or an axle with a supporting bracket in one or more embodiments.

The stop 220, in one or more embodiments, prevents the pedal assembly 112 from pivoting beyond a certain angle or point. As can be seen from FIG. 2, the stop 220 includes a portion which contacts the floor 252 to stop the pedal assembly 112 from pivoting past a certain point. In FIG. 2, the stop 220 is configured as a reverse "L" shaped structure. When the pedal assembly 112 pivots towards the user, the bottom of the stop 220 contacts the ground thus preventing further movement towards the user. It is noted that the stop 220 may be configured in various ways. In fact, any structure which prevents the pedal assembly 112 from moving past a certain point may be used as a stop 220. For example, the stop 220 may be only the lower horizontal portion of the reverse "L" shape which is attached to the pedal support 208.

It is noted that a stop 220 may not required in all embodiments. This is because a pedal assembly 112 may be allowed to pivot without restriction. The stop 220 is beneficial however, in that it holds a pedal assembly 112 in a position where the pedal assembly may be conveniently engaged and disengaged by a user. The stop 220 also holds the pedal assembly 112 in a stationary position when the power stride apparatus is not in use.

In embodiments where a spring 236 is used as a resistance device, the stop 220 may comprise one or more mounts 240 which allow one or more springs 236 to be mounted thereto.

A mount 240 may be any fastener or structure that allows a spring 236 to be removably or permanently attached. For example, the mount 240 may be one or more welds, screws, nuts, bolts, pins, hooks, loops, or the like that engages a corresponding structure of a spring 236. For example, the mount 240 may comprise a pin that engages a loop at the end of a spring 236 to hold the spring in place. In one or more embodiments, the amount 240 allows a spring 236 to be removably attached such that the spring can be replaced with a stronger or weaker spring to respectively increase or decrease the resistance provided to a user.

One or more mounts 240 may be on the frame 104 and the pedal assembly 112. In this manner, one end of a spring 236 may be attached to the pedal assembly 112 while the other end of the spring is attached to the frame 104. This allows the spring 236 to provide resistance when the pedal assembly 112 is pushed and to provide a force which the user must resist when then pedal assembly returns to its initial position.

It is contemplated that the one or more mounts 240 may allow a spring to be repositioned on the pedal assembly 112 or the frame 104. For example, in FIG. 2, a plurality of mounts 240 may be on the pedal assembly 112 and the frame 104. This allows a plurality of springs 236 to be attached to the power stride apparatus. In addition, in one or more embodiments, the one or more mounts allow a spring 236 to be repositioned by moving one or both ends of a spring to a different mount 240, For example, the angle at which the spring 236 meets a pedal assembly 112 may be changed. This adjustment of the spring 236 is beneficial in that it allows the power stride apparatus to provide various types of resistance during training. The spring provides the benefit of non-linear resistance.

The mounts 240 may be attached directly to the frame 104 or the stop 220 such as illustrated in FIG. 1. Alternatively or in addition, the mounts 240 may be attached to one or more guides 244 which can be slid or otherwise repositioned along a portion of the frame 104 or stop 220 such as in FIG. 2. In this manner, the mounts 240 may be repositioned or adjusted by moving their guides 244. Once in the desired location, the guides 244 may be secured by one or more fasteners, such as but not limited to screws, nuts, bolts, clips, pins, and clamps.

It is noted that amount 240 may be used to attach other resistance devices. For example, a resistance device comprising an elastic band may be attached with mounts 240. In addition, resistance devices comprising a weight stack and cable may be attached by attaching the cable to a mount 240. It is noted that amount 240 may be attached to the pedal support 208 or other portion of a pedal assembly 112 besides the stop 220 in some embodiments. Thus, a stop 220 may not be required to mount a spring 236 or other resistance device in all embodiments.

A resistance device comprising a spring 236 is advantageous in that it provides a variable or non-linear resistance during a user's training. In one embodiment, the spring's 236 resistance may increase as the spring is stretched. This allows the resistance to increase as the user extends his or her legs to push the pedal assemblies 112 forward. This is beneficial because, due to the physical structure of the body, a user may be capable of exerting more force as his or her legs extend. Thus, the variable resistance provides better training to the user's quads and gluts by increasing resistance as the user's capabilities increase. In contrast, a fixed resistance, such as weights, cannot increase their resistance as the leg is extended and thus training is less effective as the user extends his or her legs. Weights are considered a linear resistance because the resistance offered to the user is the same at all points along the motion of the user.

As alluded to above, other variable resistance devices may be used in addition to or instead of springs 236. For example, one or more elastic bands may be used to provide a variable resistance. In addition, the combination of one or more weight stacks with springs may be used. It is also contemplated that a fixed resistance may be used. Though training may be less effective, the benefits of the invention may still be attained with a fixed resistance. Thus, in one or more embodiments, the resistance device may be one or more weights or a weight stack and pulley assembly attached to the pedal assembly 112 by a cable or the like. It is contemplated that resistance may also be generated by one or more pistons or magnetically by one or more electromagnets or other magnets.

Typically, a user will engage a pedal assembly 112 by engaging the pedal assembly's pedal 204 with his or her foot. In this manner, the user pushes the pedal assembly 112 by pushing on the pedal 204. The pedal 204 may be substantially planar and provide a surface area sufficient to accept a user's foot. The pedal 204 may be textured or manufactured from rubber or similar materials to provide grip. As shown, the pedal 204 is rectangular in shape. It is noted that the pedal 204 may be other shapes as well. The pedal 204 may be round, rounded, or other shapes.

Figure 3:
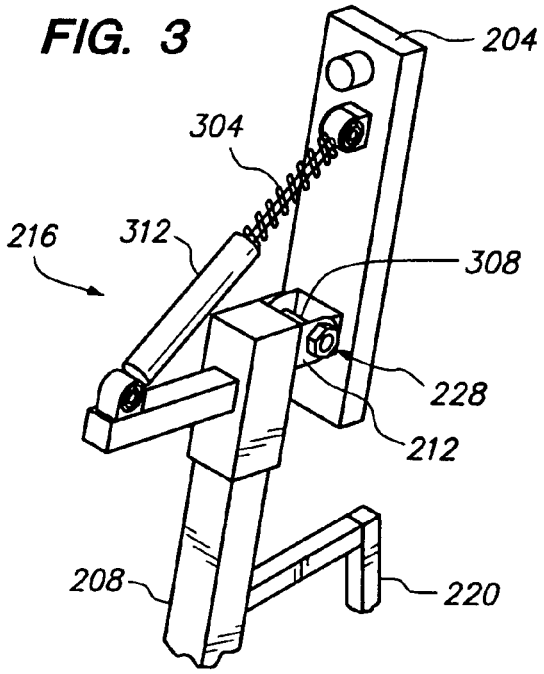
FIG. 3 is a perspective view of an exemplary embodiment of an articulating pedal.

In one or more embodiments, such as the embodiments of FIGS. 2-3, the pedal 204 is an articulating pedal. This allows the pedal 204 to rotate along with the user's foot during training. As stated above, the benefits of an articulating pedal 204 include more even distribution of force along the foot, and more focused training of the gluts and quads. In one embodiment, the articulating pedal 204 is attached to a pedal support 208 by a pedal mount 212 comprising a pivot 228. A portion of the pedal mount 212 may be attached to the pedal support 208 while another portion of the pedal mount may be attached to the pedal 204 via the pivot 228. This allows the pedal 204 to rotate.

FIG. 3 provides a closer view of an exemplary embodiment of an articulating pedal 204. The pivot 228 shown comprises an axle 308 secured within a bracket 304. The pedal 204 is attached to the axle 308 thus allowing the pedal to rotate about the axle. It is noted that, as stated above, the pivot 228 may be a variety of pivoting structures or components which allow the articulating pedal 204 to pivot or rotate.

It can be seen that the pivot 228 allows the pedal 204 to rotate with a user's foot during training. As stated, this is highly beneficial in that it allows the resistance provided through a pedal assembly to be focused on the quads and gluts. This is because the articulating pedal 204 causes the user to exert force through the user's quads and gluts when pushing or resisting the return motion of the pedal assembly.

In traditional leg press machines, the user can and does exert force through other muscles such as the calves. To illustrate, the user of a traditional leg press machine may exert force through the front of his or her foot. This force is substantially provided by the user's calf muscles. With an articulating pedal 204 however, the user is prevented from applying substantial force through the front of his or her foot because the pedal will rotate so that the user's foot remains flat on the pedal rather than transfer the user's force to the pedal assembly 112. With the articulating pedal 204, the user's strength may be applied to a pedal assembly 112 through the back portion of the foot which is substantially powered by the quads and gluts rather than the user's calves or other muscles. In this manner, the training is focused on the quads and gluts unlike traditional machines.

It is noted that some embodiments may comprise an articulating pedal 204 large enough to accept both of a user's feet.

This allows the power stride apparatus to train both sides of a user's body with a single pedal assembly 112. To illustrate, the power stride apparatus may have one pedal assembly 112 with a pedal 204 that can be engaged by both of a user's feet. The user may then train both sides of his or her body with the single pedal assembly 112. Though the benefits described above which are attainable with independent pedal assemblies 112 may be lost, training of the quads and gluts may still be achieved with the power stride apparatus. In addition, the articulating pedal 204 continues to provide the benefit of focused training on the quads and gluts even where there is only a single pedal assembly.

In one or more embodiments, the articulating pedal 204 may include a pedal stop 248 which prevents the pedal 204 from rotating past a certain point. For example, as shown in FIG. 2, a pedal stop 248 configured as a bumper prevents rotation of the pedal 204 when the bumper comes into contact with the return mechanism 216. In one embodiment, a pedal stop 248 on the pedal mount 212 contacts the pedal 204 to thereby prevent further rotation of the pedal. It will be understood that various devices or structures may be used to prevent the pedal 204 from rotating past a certain point.

FIGS. 2 and 3 also illustrate a pedal return mechanism 216 which is generally configured to provide a force which can return an articulating pedal 204 to an initial position after the pedal has been rotated. In one embodiment, this comprises a spring. In addition, a dampener may be provided between the return mechanism 216 and the pivot 228 to dampen or prevent unwanted oscillation of the return mechanism. The dampener will stabilize and steady the pedal 204 during use and may be configured to slow rotation. The initial position of the pedal 204 may be a position where the pedal is not rotated or substantially not rotated. In one embodiment the initial position is the position of the pedal 204 prior to the user pushing the pedal assembly 112. In another embodiment, the initial position is the position of the pedal 204 when the user has engaged the pedal but has not started pushing its associated pedal assembly 112.

The return mechanism's 216 force allows the pedal 204 to conform to the rotation of a user's foot during training which allows the user's foot to remain engaged to the pedal during training. The return mechanism 216 also gives the power stride apparatus a more solid feel during training because there is at least some resistance to the rotation of the articulating pedal 204. This resistance will typically be low; however, the resistance may be increased if desired such as by configuring the return mechanism 216 to provide increased resistance. For example, the user may wish to train his or her calf muscles on the power stride apparatus. In this case, the increased resistance may allow the user to exert force through his or her calves (e.g. through the front portion of the user's foot) to push and resist the return of a pedal assembly 112.

The return mechanism 216 may be mounted to a portion of the pedal support 208. For example, the return mechanism 216 may be mounted to an extension 224 of the pedal support 208. In the embodiment of FIGS. 2-3, the extension 224 extends towards the front 120 of the power stride apparatus to allow the return mechanism 216 to provide the force to return the articulating pedal 204 to an initial position. It is noted that various devices or components may be used as return mechanisms 204 to return an articulating pedal 204 and thus an extension 224 may be configured in various ways to properly position and support a return mechanism as part of a pedal assembly 112. For example, the extension 224 may be various shapes and sizes to properly support a return mechanism 216. It is noted that an extension 224 may not be required in all embodiments. For example, the return mechanism 216 may be directly attached to the pedal support 208 or other portion of a pedal assembly 112.

As shown in FIGS. 2-3, the return mechanism 216 is rotatably mounted to the extension 224 of the pedal support 208 by a pivot 228. As can be seen from the figures, this pivot 228 allows the return mechanism 216 to pivot as the pedal 204 is rotated. Generally, this allows the return mechanism 216 to provide its force at the same location on the pedal 204 even as the pedal is rotated.

In one embodiment, the return mechanism 216 comprises a piston 312 which has a rod and a spring that pushes the articulating pedal 204 back to its initial position. It will be understood that various types of pistons 312 may be used and that the pistons used may or may not include a spring in one or more embodiments. The piston 312 may be compressed when the pedal 204 is rotated towards the front 120 of the power stride apparatus. The piston 312 may then expand, providing a force which returns the pedal 204 by rotating the pedal back to its initial position. This piston may provide the dampening effect.

Various other devices or components may be used as a return mechanism 216 as well. For example, the return mechanism 216 may be a spring or the like which is mounted to the pedal 204 and the extension 224 or other portion of a pedal assembly. In addition, the pedal's 204 pivot 228 may be spring loaded in one or more embodiments. In this manner, the pivot 228 may provide a force to return the pedal 204 to its initial position.

Typically, a return mechanism 216 will be provided. However, despite the advantages of a return mechanism 216, the power stride apparatus and its articulating pedals 204 may be used without a return mechanism. In addition, other devices may be used to return the pedals 204 to an initial position in one or more embodiments. For example, the pedals 204 may include one or more straps which allow a user's foot to be secured. In this mariner, the pedals 204 conform to the rotation of a user's foot during training without a return mechanism 216.

The articulating pedals 204 and any associated return mechanism 216 may be adjustable in one or more embodiments. For example, the position of an articulating pedal 204 may be adjusted by raising or lowering the pedal relative to the pedal support. This allows the power stride apparatus to better accommodate users of various sizes. In one embodiment, an articulating pedal 204 may be moved upward or downward along a pedal support 208 to thereby respectively raise or lower the pedal. Once in the desired position, the articulating pedal 204 may be secured in place by one or more fasteners such as screws, pins, clamps, clips, and the like. Similarly, a return mechanism 216 may also be moved upward or downward along a pedal support 208 and secured in place when positioned as desired. It is contemplated that an articulating pedal 204 and return mechanism 216 may be connected in some embodiments. In these embodiments, moving the articulating pedal 204 also moves its connected return mechanism 216. Thus, both elements may be adjusted and secured in place at once.

The pedal mount 212, in one or more embodiments, may be configured to facilitate the adjustability of an articulating pedal 204, a return mechanism 216, or both. For example, the pedal mount 212 may be a sleeve or other shaped element, such as a "C" shaped element which generally conforms to the pedal support 208. In this manner, the pedal mount 212 may slide or be moved along the pedal support 208 and the secured. This consequently moves and secures the pedal mount's associated articulating pedal 204. It is contemplated that the return mechanism 216 may be attached to a pedal mount 212 as well. In this embodiment, moving and securing the pedal mount 212 moves and secures the pedal 204 as well as the pedal's return mechanism 216. The pedal mount 212 may be elongated or otherwise configured to accommodate attachment of both the articulating pedal 204 and the return mechanism 216 in one or more embodiments. In addition, it is noted that the pedal support's 208 extension 224 may be attached to the pedal mount 212 to secure the return mechanism 216 to the pedal mount to allow the extension and return mechanism to be movable.

Operation of the power stride apparatus will now be described with regard to FIGS. 4A-4C. In general, these figures illustrate one repetition of training on the power stride apparatus. For clarity, the figures show both pedal assemblies 112 moved simultaneously by the user's left and right legs. As stated, it is specifically contemplated that the pedal assemblies 112 may be moved independently. Thus, though shown as moving simultaneously, each pedal assembly 112 may be independently or simultaneously moved as desired by the user. For example, the pedal assemblies 112 may be pushed one at a time or both pedal assemblies may be pushed at the same time. In addition, it is noted that the user may only desire to train one side of his or her body and thus one pedal assembly 112 may be moved while the other remains stationary. For example, the user may utilize the power stride apparatus to rehabilitate his or her left or right side after an injury. Each pedal assembly 112 may have a different resistance associated with it to provide a different level of training to each leg.

Figure 4A:
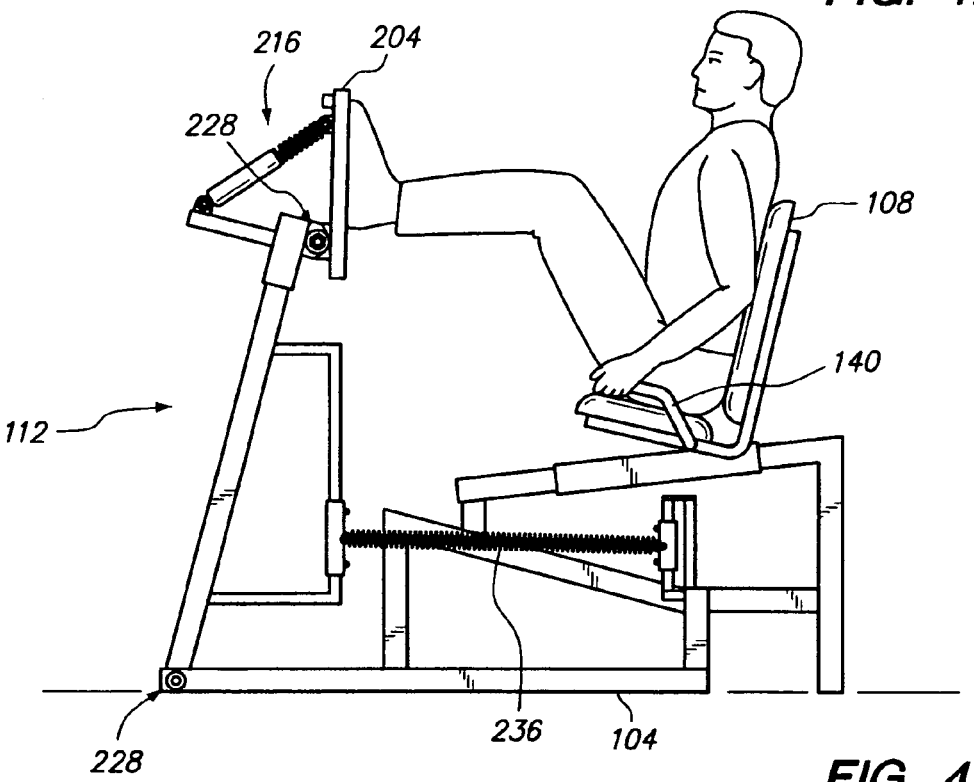
FIGS. 4A-4C are side views of an exemplary embodiment of a power stride apparatus in use.

FIG. 4A illustrates a user who is seated in the power stride apparatus and engaging the pedal assemblies 112 by placing his or her feet in contact with the articulating pedals 204, As can be. seen, the user is also grasping the handles 140 for additional stability. It is noted however, that the user need not grasp the handles 140 in all embodiments, and that handles may not be provided in all embodiments. This position will be referred to as the user's initial position for training the quads and gluts on the power stride apparatus. In the initial position, the user is generally preparing to exert force through his or her legs to push the pedal assemblies 112 forward. Also, in some embodiments, the pedal assemblies 112 may be resting on their stops 220 in the initial position. In this position, the user's leg muscles are at their weakest and most prone to injury. As such, the variable springs 236 provide the least amount of resistance.

Figure 4B:
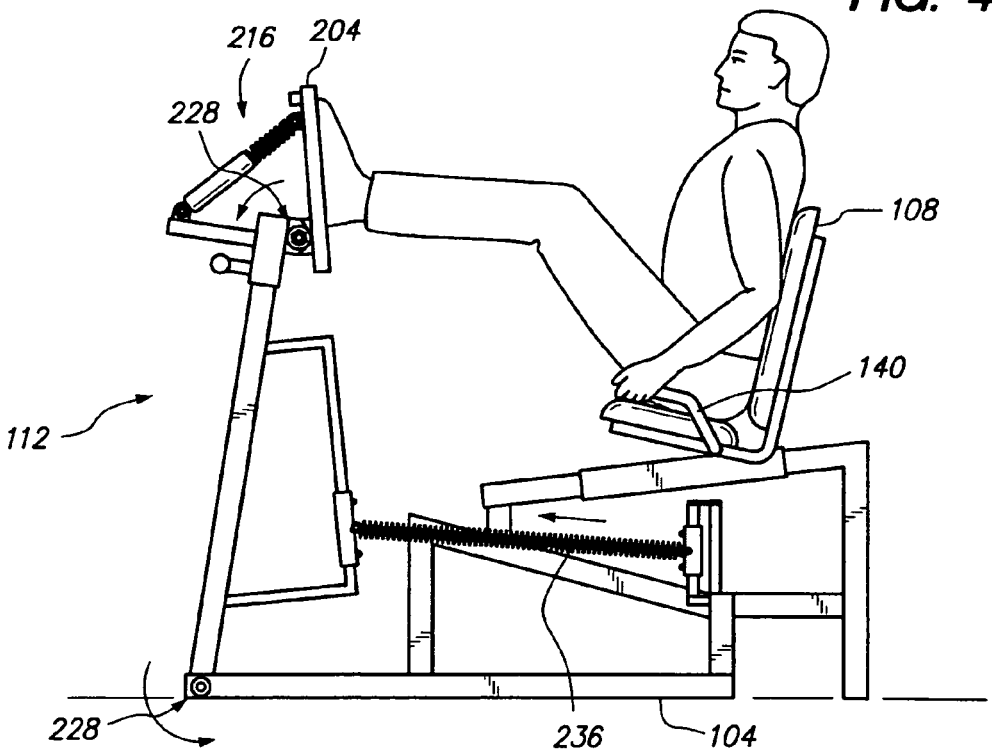

FIG. 4B illustrates a user pushing the pedal assemblies 112 of an exemplary embodiment of the invention forward. As can be seen the user has extended his or her legs relative to the initial position thereby pushing the pedal assemblies 112 forward. As shown by the arrow near the base of the frame 104, each pedal assembly 112 rotates relative to the frame around a pivot 228. The user's feet may also rotate forward as a consequence of the user pushing the pedal assemblies 112. As shown by the arrow near the articulating pedals 204, the pedals rotate along with the user's feet compressing the return mechanism 216. In this position, spring 236 provides more resistance to the user, as compared to the position of FIG. 4*a*.

FIG. 4B also illustrates the benefit of the articulating pedals 204. As can be seen, the user is prevented from applying significant force to the pedal assemblies 112 through just the toe or ball portion of his or her feet. Instead, this force rotates the articulating pedals 204, Thus, the user must exert force through his or her quads and gluts to push the pedal assemblies 112 forward with his or her entire foot, including the heel portion of the foot. As stated above, this focuses training on the quads and gluts making their training more effective.

As the user pushes the pedal assemblies 112 forward, the attached springs 236 are stretched, as shown by the arrow near the spring, thereby providing resistance to the user's force. In one or more embodiments, the resistance provided by a spring 236 is variable. Thus, in some embodiments, the resistance provided by the spring 236 may increase as the pedal assemblies 112 are moved.

Figure 4C:
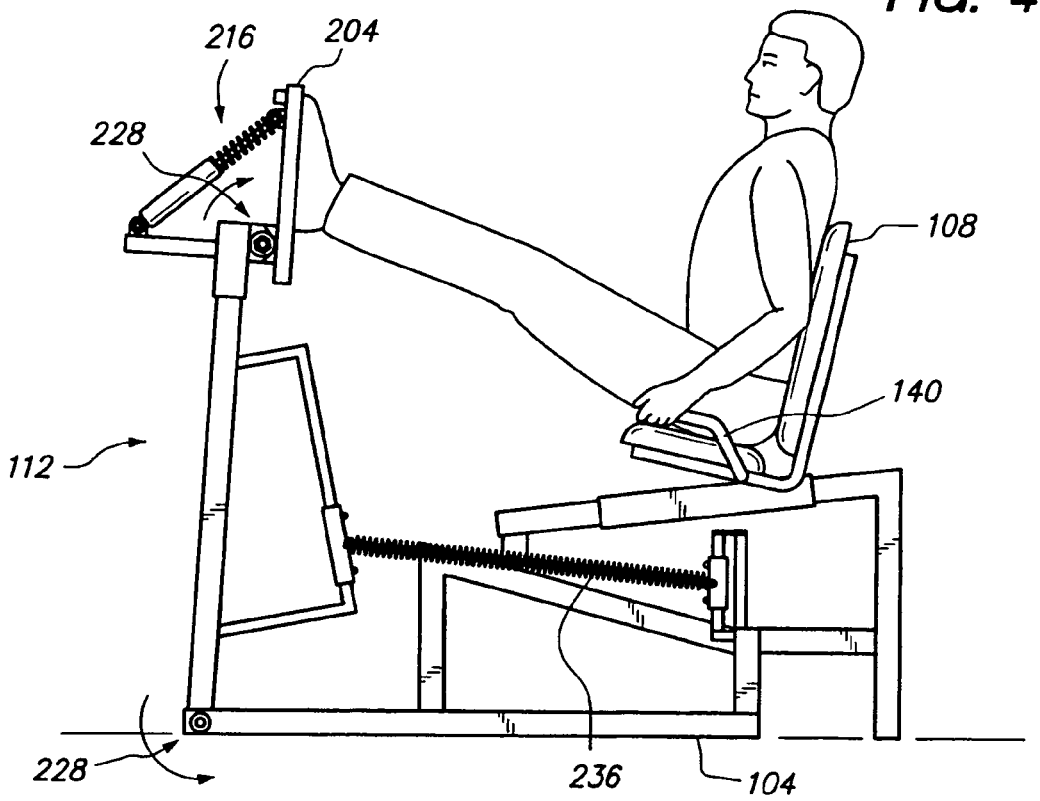

FIG. 4C illustrates a user who has pushed the pedal assemblies 112 as far as he or she can, or as far as the user desires. This position will generally be known as the extended position. As can be seen, the pedal assemblies 112 have been rotated further away from the user and the springs have been stretched further as well. The user's feet may rotate back towards the user in the extended position. The return mechanisms 216 may provide a force to rotate the articulating pedals 204 with the user's feet as shown by the arrow near the pedals 204. It will be understood that a user's feet may rotate differently than described herein and that the articulating pedals 204 and return mechanisms 216 may perform their respective functions regardless of how a particular user's feet rotate during training.

Once the user has pushed the pedal assemblies 112 to the extended position, the user may reduce the force applied through his or her legs to allow the springs 236 to return the pedal assemblies back to their initial position. As can be seen from FIG. 4C, the springs 236 will pull the pedal assemblies 112 such that they rotate back to the initial position as illustrated in FIG. 4A. In the initial position, a stop 220 may come into contact with the floor thereby stopping the rotation of the pedal assemblies 112.

As the pedal assemblies 112 return to the initial position, the user may resist the force provided by the springs 236. Similar to pushing the pedal assemblies 112, the user may resist the return of the pedal assemblies by exerting a force through his or her quads and gluts. In this manner, the user's quads and gluts are trained when pushing and resisting the return of the pedal assemblies 112.

The user may perform as many repetitions of the above training sequence as desired. In addition, as stated, the user may move the pedal assemblies 112 independently. Thus, the user may push one pedal assembly 112 while resisting the return of the other pedal assembly. In this manner, the user may train his or her quads and gluts using the power stride apparatus.

Figure 5:
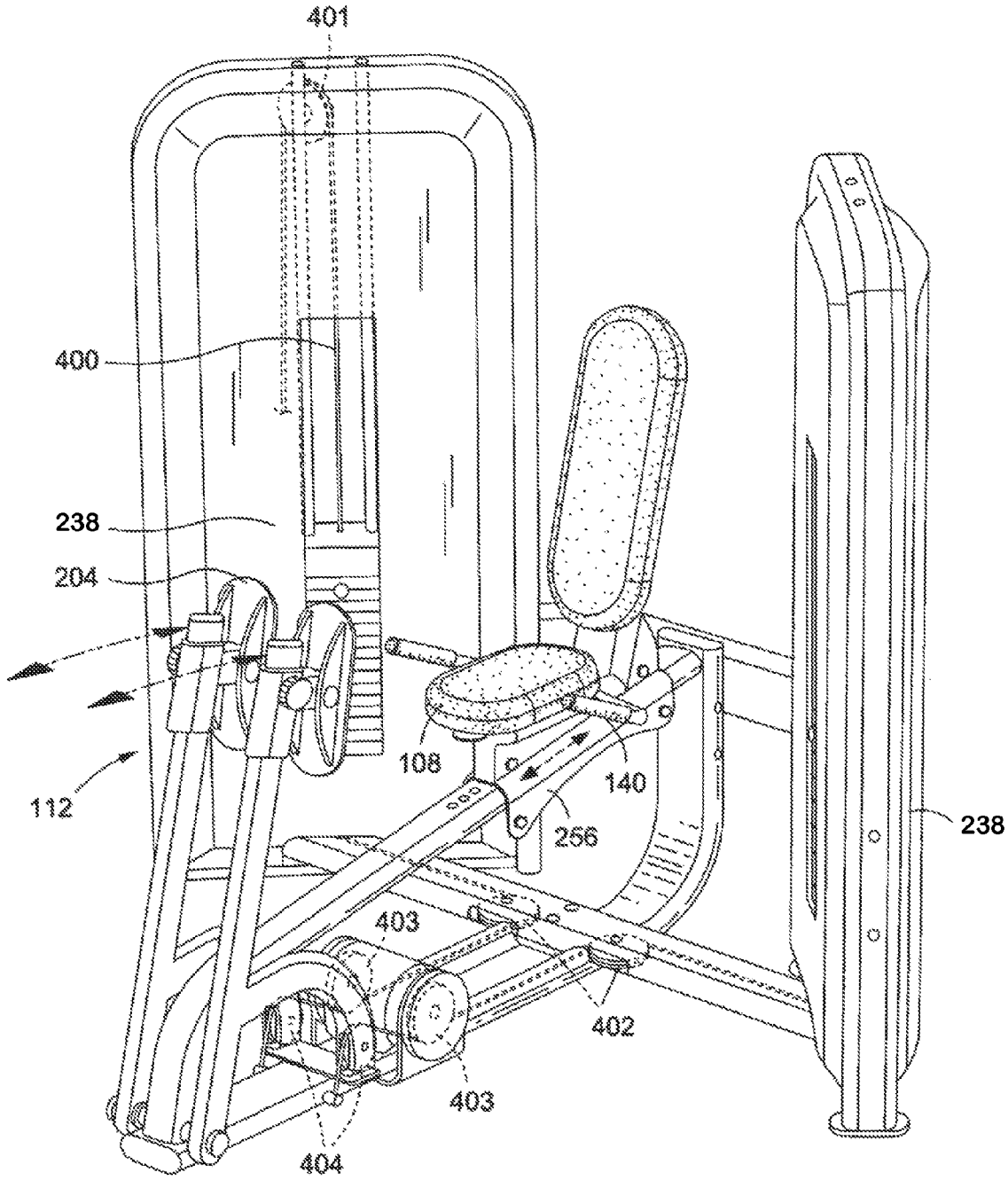
FIG. 5 is a perspective view of another exemplary embodiment of a power stride apparatus.

FIG. 5 illustrates another embodiment of the power stride apparatus. In this embodiment, resistance is provided by two resistance devices 238. The user sits on the seat 108 with knees bent and then exerts a force on one or more of the pedal assemblies 112 and pedals 204 in an effort to straighten the leg or legs. The extent of the initial knee bend can be altered by changing the distance between the seat 108 and the pedal assembly 112 using the guide 256 to slide the seat closer to or farther from the pedal assembly 112. When a force is exerted by one leg on one pedal 204 the resistance device 238 on the corresponding side is engaged. When a force is exerted by both legs on both pedals 204 the resistance device 238 on both sides is engaged. The cable 400 extends from the base of the weight stack vertically upward through a first pulley 401. The cable 400 then travels vertically downward until it is redirected by another pulley The cable 400 then travels horizontally towards the center of the power stride apparatus until it reaches another pulley 402 which redirects the cable 400 ninety degrees towards the pedal assembly 112. The cable then feeds through one pulley 403 and on other pulley 404 before being redirected by another pulley upward toward the pedal assembly 112 where the cable is attached. The two resistance devices 238 are arranged at approximately forty-five degrees to the seat 108 to allow for ease of egress and digress, to maximize stability of the machine, and to minimize the footprint of the power stride apparatus.

Figure 6B:
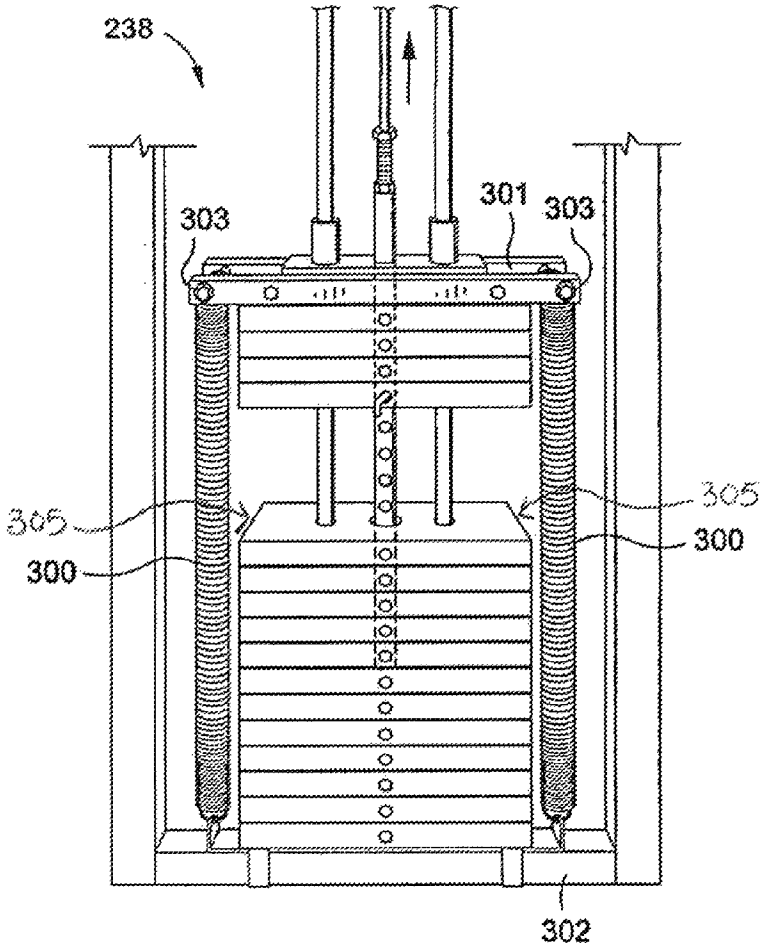
FIGS. 6A and 6B are perspective views of another exemplary embodiment of a resistance assembly of the power stride apparatus.
Figure 6A:
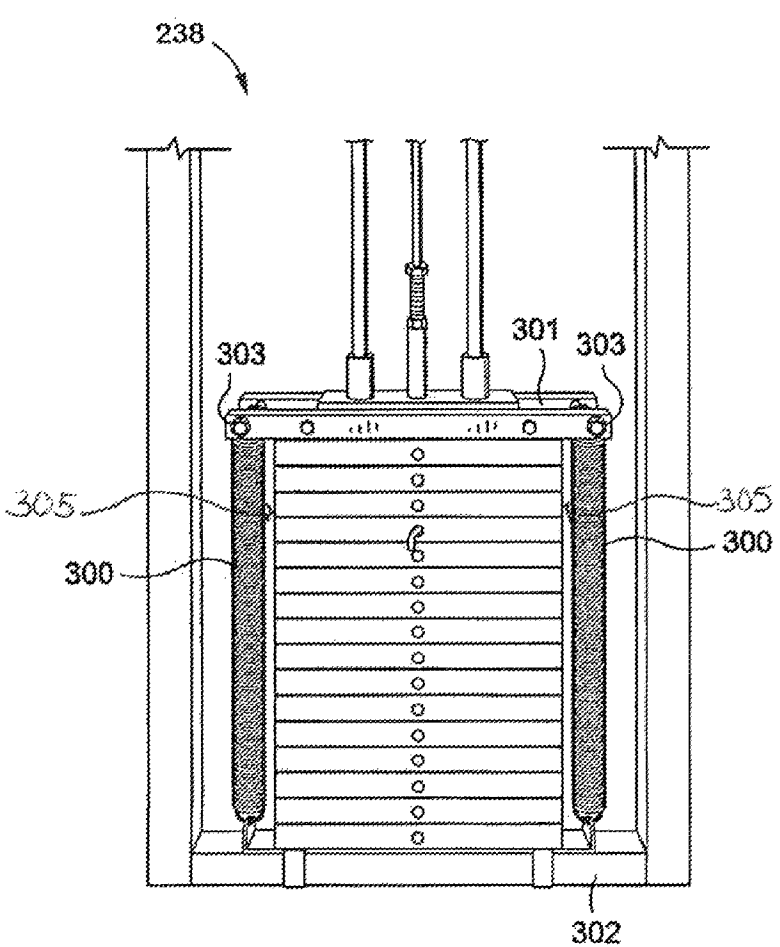

FIGS. 6A and 6B illustrate another embodiment of a resistance device 238. In this embodiment, variable resistance is provided by one or more elastic elements (which in this embodiment are springs 300), in addition to the weight stack. It is contemplated that other elastic elements such as elastic cords or bands and the like may be used in addition to or instead of a spring to provide variable resistance. Referring to FIGS. 6A and 6B, the top ends of springs 300 are secured to lifting mount 301, and the bottom ends of springs 300 are secured to frame mount 302. Lifting mount 301 and frame mount 302 provide structures to which the ends of the springs 300 may be secured. Springs 300 are attached to frame mount 302 on one end at and approximately the center of bolt 303 on lifting mount 301 on the other end. Alternate embodiments of the disclosed invention may utilize a single spring or multiple springs. Springs 300 alternatively may be permanently attached to these mounts by one or more welds, or, springs 300 may be removably attached to these mounts. For example, the mounts may comprise one or more eyelets or loops which engage hooks on the springs 300, or vice versa. Removable attachment allows the amount of resistance provided by the resistance device 238 to be changed. For example, additional springs 300 may be added, or one or more springs (or other elastic elements) may be replaced with stronger or weaker springs (or other elastic elements), as desired. It is contemplated that any fastener, structure, adhesive, or the like that is capable of securing the springs may be used as a lifting mount 301 or frame mount 302.

Still referring to FIGS. 6A and 6B, springs 300 are aligned along both narrow non-face sides 305 of the weight stack in a central position. In operation, this arrangement minimizes the friction between the portion of the weight stack that is engaged and the guide. In addition, as the weight stack is lifted, the symmetrical location of springs 300 on the sides and approximately adjacent to the longitudinal midline of the weight stack as shown allows the weight stack to maintain relative stability and balance during movement. Further, this configuration is advantageous because, as the portion of the weight stack that is engaged is lifted, springs 300 begin to stretch or open and add intensity as and until the weight stack reaches its ultimate height. The lower intensity at the start and end of the repetition helps protect the lifter from injury in their most vulnerable position because the muscle is at its strongest when the weight stack and spring are at its maximum height, and the muscle is at its weakest when the weight stack and spring are at the starting and ending position. The combination of the weight stack and springs 300 allows the lifter to start with a manageable amount of weight to start the repetition and to increase the intensity as the leg or legs are extended towards a straight leg or legs. The result is a smooth and intense repetition for the lifter that optimizes the workout and, among other things, decreases the risk of injury.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A power stride apparatus comprising:

a frame;

a first pedal assembly rotatably attached to the frame;

a second pedal assembly rotatably attached to the frame and capable of rotatable movement independent from the first pedal assembly;

a seat configured to support a user facing the first and second pedal assemblies;

a first resistance device attached to the frame and the first pedal assembly, the first resistance device configured to resist rotational movement of the first pedal assembly relative to the frame, and including a first weight stack with variable weight setting supported upon a first base, a first lifting mount connected to the first weight stack, and a first elastic element connected between the first base and the first lifting mount; and, a second resistance device attached to the frame and the second pedal assembly, the second resistance device configured to resist rotational movement of the second pedal assembly relative to the frame, and including a second weight stack with variable weight setting supported upon a second base, a second lifting mount connected to the second weight stack, and a second elastic element connected between the second base and the second lifting mount.

2. The power stride apparatus of claim 1, wherein the elastic elements of the first and second resistance devices are springs.

3. The power stride apparatus of claim 1, wherein the resistance of the first resistance device to rotational movement of the first pedal assembly may be different from the resistance of the second resistance device to rotational movement of the second pedal assembly.

4. The power stride apparatus of claim 1, wherein the variable weight setting of the first weight stack is independent from the variable weight setting of the second weight stack.

5. The power stride apparatus of claim 4, wherein weight settings for first pedal assembly may be different from the weight setting for the second pedal assembly.

6. The power stride apparatus of claim 1, wherein the first and second weight stacks each have tops and the first and second lifting mounts are connected to the tops of the first and second weight stacks.

7. The power stride apparatus of claim 1, wherein the first and second weight stacks each have tops and the first lifting mount is connected to the top of the first weight stack, and the second lifting mount is connected to the top of the second weight stack.

8. The power stride apparatus of claim 1, wherein the first pedal assembly is attached to the first resistance device by a cable, and the second pedal assembly is attached to the second resistance device by a cable.

9. The power stride apparatus of claim 1, wherein the position of the seat on the frame is adjustable.

10. The power stride apparatus of claim 1, wherein each weight stack is configured as a forty-five degree angle to the seat.

11. The power stride apparatus of claim 7, wherein the elastic elements are aligned along a narrow, non-face side of each weight stack, with the first and third elastic elements on opposite side of the first weight stack, and with the second and fourth elastic elements on opposite sides of the second weight stack.

12. The apparatus of claim 1 further comprising one or more handles located adjacent to the seat.

13. A power stride apparatus comprising:

a frame;

a first elongated pedal assembly with first end attached to a pedal and second end rotatably attached to the frame;

a second elongated pedal assembly with first end attached to a pedal and second end rotatably attached to the frame and capable of rotatable movement independent from the first pedal assembly;

a seat configured to support a user facing the first and second pedal assemblies, the seat adjustably configured to the frame to adjust the distance between the user and the pedals;

a first resistance device attached to the frame and the first pedal assembly, the first resistance device configured to resist rotational movement of the first pedal assembly relative to the frame, and including a first weight stack with variable weight setting supported upon a first base, a first lifting mount connected to the first weight stack, and two elastic elements connected between the first base and the first lifting mount on opposite sides of the first weight stack; and, a second resistance device attached to the frame and the second pedal assembly, the second resistance device configured to resist rotational movement of the second pedal assembly relative to the frame, and including a second weight stack with variable weight setting supported upon a second base, a second lifting mount connected to the second weight stack, and two elastic elements connected between the second base and the second lifting mount on opposite sides of the second weight stack.

* * * * *